US005205023A

United States Patent [19]

Hunter et al.

[11] Patent Number: 5,205,023

[45] Date of Patent: Apr. 27, 1993

[54] CHILD-RESISTANT BUCKLE AND BUCKLE GUARD COMBINATION

[76] Inventors: Robert M. Hunter; Mary M. Hunter, both of 320 S. Willson Avenue, Bozeman, Mont. 59715

[21] Appl. No.: 592,577

[22] Filed: Oct. 4, 1990

Related U.S. Application Data

[63] Continuation-in-part of Ser. No. 510,621, Apr. 18, 1990.

[51] Int. Cl.[5] ..... A44B 11/00

[52] U.S. Cl. ..... 24/633; 24/590

[58] Field of Search ..... 24/633, 634, 487, 590; 70/18; 292/202

[56] References Cited

U.S. PATENT DOCUMENTS

| | | | |
|---|---|---|---|
| 3,876,237 | 4/1975 | Hayes, Jr. et al. | 292/202 |
| 4,624,033 | 11/1986 | Orton | 24/633 |
| 4,674,303 | 6/1987 | Salcone, II | 24/633 |
| 4,675,954 | 6/1987 | Gullickson | 24/633 |
| 4,731,912 | 3/1988 | Boriskie et al. | 24/633 |
| 4,878,277 | 11/1989 | Portuese | 24/633 |
| 4,901,407 | 2/1990 | Pondola et al. | 24/633 |
| 4,930,324 | 6/1990 | Meier | 70/18 |
| 4,939,824 | 7/1990 | Reed | 24/633 |
| 4,987,662 | 1/1991 | Haffey et al. | 24/633 |

FOREIGN PATENT DOCUMENTS

| | | | |
|---|---|---|---|
| 8401275 | 4/1984 | European Pat. Off. | 24/633 |

*Primary Examiner*—Victor N. Sakran

[57] ABSTRACT

A child-resistant buckle and buckle guard combination is disclosed that relies for its effectiveness on differences in the ways young children and adults think rather than on presumed (but often non-existent) strength or dexterity differences. The child-resistant feature comprises a combination lock mechanism that incorporates at least one directly manipulated member, and, in some embodiments, at least one indirectly movable member. The device is buckled into a conventional safety belt buckle by means of a tongue-like connector. A housing or guard denies access to the push button of the conventional safety belt buckle.

12 Claims, 9 Drawing Sheets

CHILD-RESISTANT BUCKLE AND BUCKLE GUARD COMBINATION

This invention was made with Government support under Contract No. DTRS-57-89-C-00147 awarded by the U.S. Department of Transportation. The Government has certain rights in the invention.

The present application is a continuation in part of copending application Ser. No. 510,621 filed Apr. 18, 1990, and entitled CHILD-RESISTANT SAFETY BELT BUCKLE.

FIELD OF INVENTION

This invention relates to the field of child-resistant safety belt buckles and, more particularly, to the field of child-resistant, push-button safety belt buckles.

The inventions disclosed herein were developed, in part, during a Small Business Innovation Research (SBIR) project funded by the United States (U.S.) Department of Transportation. The inventions are described in detail in a report entitled "Cognitive Skill Based Child-Resistant Safety Belt Buckle Device" by Yellowstone Environmental Science, Inc., Bozeman, Mont.

BACKGROUND

Motor vehicle crashes are the leading cause of fatal injury of children under age five in the U.S. In 1985, motor vehicle crashes killed 1,195 children under age five and, in 1986, moving motor vehicles injured 246,000 children under age five in the U.S.

Experts estimate that 66 to 90 percent of injuries and deaths could be prevented if child passengers were properly restrained in car safety seats (CSS's). In essentially all CSS systems, the seat portion of the device is held to the vehicle seat using at least a vehicle lap safety belt. Both the ends of the vehicle safety belt and the ends of the CSS harness straps must be connected during use for the CSS to function correctly. These connections are typically made by buckle assemblies that are similar in design. They comprise a perforated or notched latch plate (tongue) that is inserted into the buckle. Stop means (typically an indent or tang) on a latch member inside the buckle interact with the tongue to prevent its removal from the buckle prior to release by the buckle user.

Research funded by the National Highway Traffic Safety Administration (NHTSA) has shown that unauthorized release of safety belt and CSS harness buckles by young children can reduce the effectiveness of these child restraints to "close to zero." A survey of CSS users presented in the report referenced above found that 36 percent reported that their child had released a safety belt buckle at an inappropriate time and 21 percent had released a CSS harness buckle at an inappropriate time. There is interest in improving conventional safety belt buckles by adding child-resistant features to prevent unauthorized release of these buckles by young children. For the purposes of this disclosure, the term "safety belt buckle" includes the buckles on vehicle safety belts (also called seat belts), those that hold the ends of CSS harnesses together and those that secure the ends of CSS harnesses or CSS harness shields to CSS frames.

Prior art devices for adding child-resistance to safety belt buckles have used two basic approaches to achieve this end. One approach is to enclose the buckle in a child-resistant housing. This approach is appropriate for after-market devices that would be used to retrofit conventional buckles. The concept is difficult to implement because a wide variety of buckles are in current use having a variety of shapes and release mechanisms. It is also difficult to design buckle housings that would align actuator means on the housing with the push button on the non-child-resistant buckle. Review of the inventions disclosed by Orton in U.S. Pat. No. 4,624,033 illustrate some of the problems involved.

A second approach is to add integral child-resistant features to conventional buckle designs. Prior art devices to add integral child-resistant features to buckles have comprised movable members mounted on the buckle body for preventing movement of the latch member to a position that releases the buckle tongue, hence providing a measure of child resistance. Because buckle body components are present only on the base (and possibly the sides) of a free-standing buckle, the child-resistant feature(s) must also be attached to the base (or sides) of the buckle. In that safety belts and buckles should be worn snug against user's body, child-resistant features located on the base (or sides) of a buckle can be difficult to use. For this reason, buckles having child-resistant features attached to the top cover of the buckle and to the push button are of interest. Such buckle designs would be less likely to discourage safety belt and CSS use whereas inconvenient-to-operate child-resistant features would discourage use.

NATURE OF INVENTION

The present invention combines the advantages of the buckle housing approach with those of a buckle with integral child-resistant features. One preferred embodiment of the invention comprises a cantilevered plate- or channel-shaped guard that covers at least the push button of the conventional (non-child-resistant) buckle. A tongue-like connector fixed to a child-resistant buckle body inserts into the female part of the conventional push-button buckle.

Another preferred embodiment of the invention comprises a tubular housing or sleeve that surrounds a tongue-like connector attached directly to a child-resistant buckle body. The guard or housing is adapted to accommodate a wide variety of non-child-resistant buckles and the tongue is designed to semipermanently attach the child-resistant buckle to the same variety of non-child-resistant buckles. The guard or housing hides and renders inaccessible for normal use the non-child-resistant buckle. By this means, it is not necessary to design the guard or housing to exactly fit each model of non-child-resistant buckle and to design a child-resistant actuator mechanism for the housing that will allow repeatedly and reliable adult release of the non-child-resistant buckle. In fact, the guard may be designed to allow it to be forcibly removed (e.g., by breaking its means of attachment to the child-resistant buckle body) thereby allowing for normal operation of the push-button release mechanism in an emergency.

In the broadest sense, the invention is a child-resistant buckle and buckle guard combination comprising a buckle having a child-resistant feature comprising a combination lock mechanism having one or more tumblers, means for connecting said buckle to a conventional safety belt buckle body (e.g., a tongue- or leaf-shaped connector), and means for denying access to a conventional safety belt release mechanism (e.g., a guard or sleeve).

It is an object of this invention to improve conventional safety belt buckles by providing child resistance. It is an object of this invention to provide an after-market product to add child resistance to conventional buckles on lap safety belts used to secure CSS's in vehicles. It is a further object of this invention to disclose child-resistant safety belt buckle and buckle guard combination providing child resistance that is cognitive skill based. Cognitive skill based child resistance relies on differences in the ways that children and adults think rather than on presumed differences in strength or manual dexterity between children and adults. It is a further object of this invention to provide a child-resistant buckle and buckle guard combination that allows for quick release by an adult in an emergency situation.

Additional objects and features of the invention will appear from the following description in which the preferred embodiments have been set forth in detail in conjunction with the accompanying drawings.

BRIEF DESCRIPTION OF THE DRAWINGS

These features will be better understood by reference to the accompanying drawings which illustrate presented preferred embodiments of the invention.

In the drawings.

DETAILED DESCRIPTION

Figure 1:
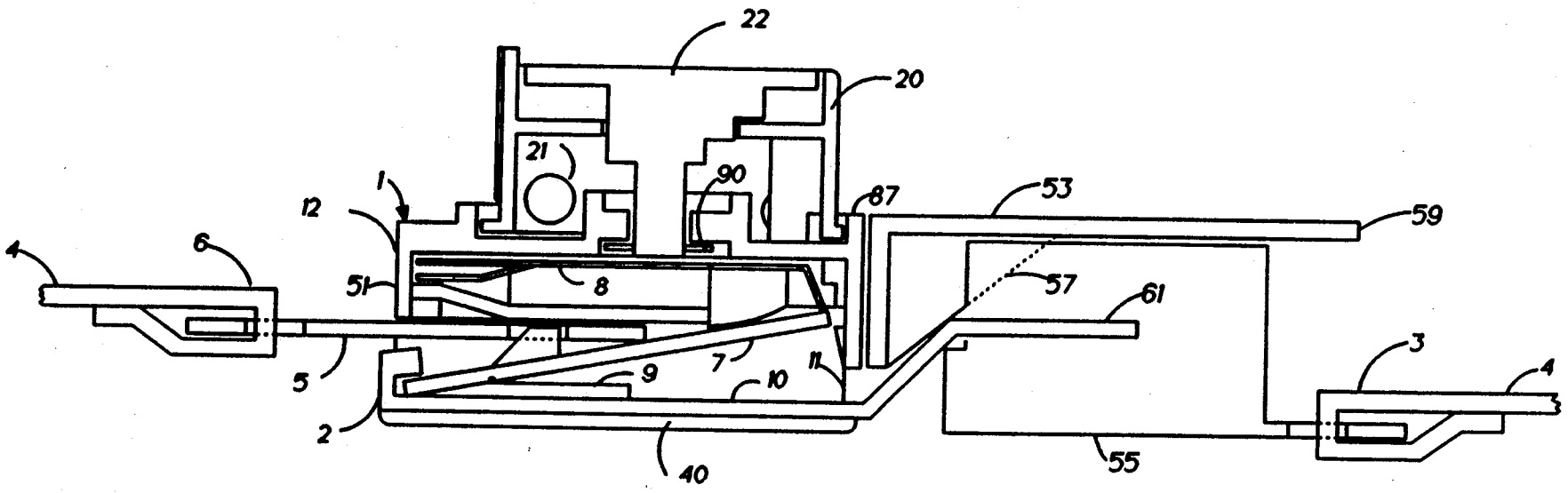
FIG. 1 is a cross-sectional view of a child-resistant buckle and buckle guard combination that incorporates a guard.

Referring to FIG. 1, a child-resistant buckle and buckle guard combination 51 is shown comprising a guard 53 which denies access to the push button of conventional buckle 55. Guard 53 is attached to top cover 12 of push-button buckle 1 and may be integrally molded with top cover 12. Guard 53 may include sides 57. End 59 of guard 53 may extend beyond the end of conventional buckle 55. Combination 51 is attached to conventional buckle 55 via tongue-like connector 61.

In an emergency situation, guard 53 may be forcibly separated from top cover 12 by an adult user's placing the tips of his fingers under end 59 and breaking the attachment of guard 53 to top cover 12 by pulling guard 53 away from conventional buckle 55. With guard 53 removed, the push button of conventional buckle 55 is accessible to manipulation to allow separation of the safety belt segments.

Figure 2:
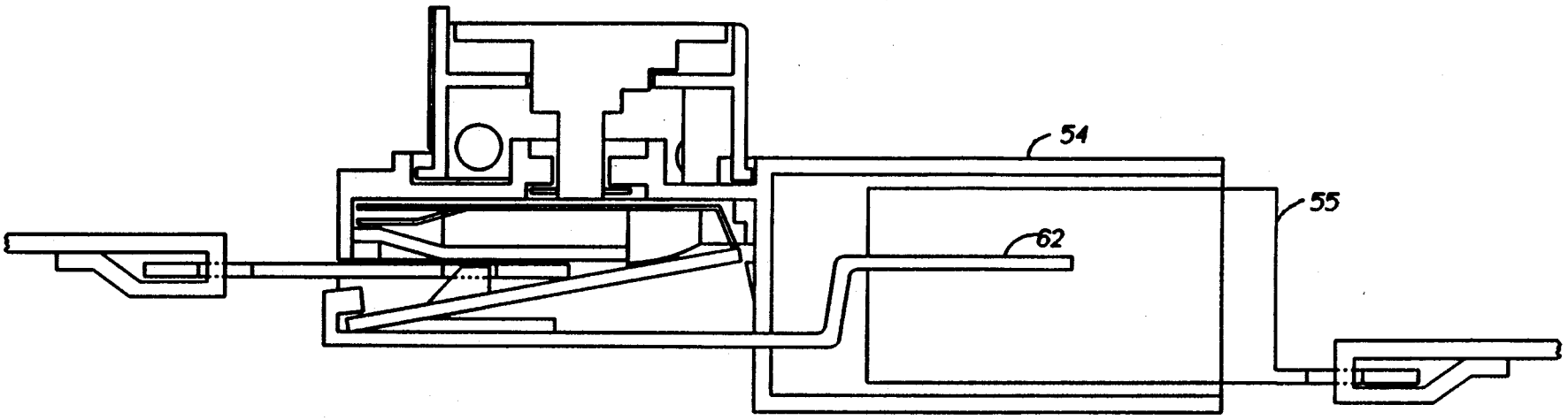
FIG. 2 is a cross-sectional view of a child-resistant buckle and buckle guard combination that incorporates a housing.

A second embodiment of the invention comprising housing or sleeve 54 is shown in FIG. 2. Connector 62 is tongue- or leaf-shaped and adapted to connect combination 51 to conventional safety belt buckle 55. Housing or sleeve 54 is adapted to cover the actuator means of conventional safety belt buckle 55 (such as the push button) and thereby to hide and deny access to conventional safety belt buckle 55 release mechanism. Sleeve 54 may have a small hole or other means for allowing infrequent access by an adult to the conventional safety belt push button. This approach to providing adult access was disclosed by Morris in U.S. Pat. No. 4,497,094 and by Orton in U.S. Pat. No. 4,624,033. Alternatively, adult access may be provided by providing a deflectable sleeve portion as disclosed by Orton in U.S. Pat. No. 4,624,033 and Gullickson in U.S. Pat. No. 4,675,954.

In an alternative embodiment, sleeve 54 comprises neither a small hole nor a deflectable portion. Adult access is gained by inserting a tool such as the end of a small pry bar into the sleeve through the same opening through which the buckle is inserted. The pry bar is pivoted to depress the buckle push button.

In yet another embodiment, a box-like device as disclosed by Boriskie et al. in U.S. Pat. No. 4,731,912 is substituted for sleeve 54. Child access is denied by designing the latch on the box-like device to require more strength than children under age five are capable of exerting.

To install combination 51 on a conventional safety belt buckle, connector 62 is inserted into the body of the conventional buckle until the buckle latch engages with connector 62 to prevent its release from the conventional buckle. As connector 62 is inserted into the body of the conventional buckle, sleeve 62 envelopes the buckle thus denying access to its release mechanism. In this way, combination 51 is semipermanently installed on a conventional buckle.

When the combination 51 is no longer required or to move it to another buckle, an object such as a key may be inserted in a small hole to depress the push button on the conventional buckle. Connector 62 is then released and withdrawn from the buckle body. Much more convenient separation of the safety belt segments can be achieved during normal buckle guard operation by unlocking the cognitive skill based child-resistant feature.

Referring to FIGS. 1 and 2, a push-button safety belt buckle 1 is shown comprising a metal body 2 that is connected to one end 3 of a segment safety belt 4 or harness and a leaf or tongue 5 that is connected to end 6 of a segment of safety belt 4. A latch 7 which may be a lever is mounted in body 2 that engages with tongue 5 to prevent the release of tongue 5 from body 2. An operator means such as push button 8 mounted above latch 7 is depressed to pivot or otherwise push downward latch 7 and thereby to release tongue 5 from body 2. Push button 8 and latch 7 are returned to position that allows reinsertion of a tongue 5 by spring 9.

Referring to FIGS. 1, 2, 3, and 4, body 2 may be a flat plate or may be U-shaped or channel-shaped in vertical cross section with its base 10 (bottom) and sides 11 (if any) providing structural (tensile) strength to buckle 1. A top cover 12 having a hole 13 to provide access to push button 8 through top cover 12 is attached to the top of buckle 1. A bottom cover 40 may also be provided. The material of the cover(s) may be plastic or metal and the covers are distinguished from the body 2 in that they provide essentially no structural (tensile) strength to buckle 1.

For the purposes of this disclosure, the term "horizontal plane" means a plane coincident with the plane of top cover 12 when buckle 1 is lying on its base 10. The "vertical plane" is any plane perpendicular to the "horizontal plane." The "longitudinal axis" of buckle 1 lies along its longitudinal centerline and is coincident with the direction of the tensile forces the buckle resists during use.

In one preferred embodiment, incorporating a one-tumbler combination lock, shown in FIGS. 1 through 8, buckle 1 is modified by adding an integral child-resistant feature comprised of a rotatable member 20 mounted on top cover 12. Rotatable member 20 may be mounted on top cover 12 by snapping lip 80 on skirt 81 of rotatable member 20 past catches 85 and 86 on mounting ring 87 on top cover 12. Rotatable member 20 turns in a single, horizontal plane about an axis perpendicular to the longitudinal axis of buckle 1. The edge of rotatable member 20 may extend to the edges of top cover 12. Means for returning rotatable member 20 to the locked condition, such as spring 21 may be mounted between rotatable member 20 and top cover 12. Either a portion of push button 8 or a separate component, such as actuator button 22 extends upward through hole 23 in the center of the disk portion 24 of rotatable member 20. If an actuator button is used, it is adapted to not rotate relative to top cover 12 but to capable of moving vertically (up and down) relative to top cover 12. Actuator button 22 may be held in hole 13 in top cover 12 by retaining ring 90. In an alternative embodiment, the end of actuator button 22 may be adapted to shape into hole 13. Hole 23 is centered on the vertical (rotational) axis of rotatable member 20. Hole 23 may be non-circular in shape to accommodate a noncircular portion of actuator button 22.

In this embodiment, hole 23 in the disk portion 24 of rotatable member 20 is generally circular in horizontal cross section except for at least one notch 25 and preferably three rectangular notches 25, 26, and 27 in the circumference of otherwise circular hole 23. The portion of either push button 8 or actuator button 22 that extends upward through hole 23 in disk portion 24 of rotatable member 20 has at least two cross-sectional shapes. Lower portion 28 that is coincident with disk portion 24 when buckle 1 is in the locked, child-resistant condition is circular in horizontal cross section. Upper portion 29 is circular in horizontal cross section with essentially the same diameter as lower portion 28 for the most part, but in at least one part of the circle circumference of upper portion 29, a rectangular projection 30 is present. Preferably, three rectangular projections 30, 31, and 32 are present. The rectangular projections 30, 31, and 32 are slightly smaller than the rectangular notches 25, 26, and 27 in the circumference of hole 23 in the disk portion 24 of rotatable member 20. In a preferred embodiment, one of the rectangular projections, rectangular projection 30, and one of the rectangular notches, rectangular notch 25, are longer in radial extent than its other two counterparts.

In at least one position of rotation of rotatable member 20, hole 23 in disk portion 24 of rotatable member is capable of accommodating both lower portion 28 and upper portion 29 of actuator button 22 in that those portions can move vertically (up and down) through hole 23. In other positions of rotation, hole 23 is capable of accommodating only the essentially circular lower portion 28 of actuator button 22 which is presented to it when push button 8 is in the upward, locked, child-resistant condition.

The operation of this embodiment of the invention may also be understood by reference to FIGS. 1 through 8. To unlock the child-resistant feature, rotatable member 20 is turned to place rectangular notch 25 in the circumference of hole 23 in disk portion 24 of rotatable member 20 into alignment with the rectangular projection 30 in the circumference of upper portion 29 of the relatively nonrotating actuator button 22. Actuator button 22 may then be depressed thus depressing push button 8 and releasing tongue 5 from body 2 of buckle 1. When downward pressure on push button 8 is released, push button 8 and actuator button 22 are moved upward indirectly by latch 7 and spring 9 and rotatable member 20 is driven by spring 21 to rotate to the locked position.

In an alternative embodiment, catches 85 and 86 are not provided and rotatable member 20 is mounted on an upwardly extending portion of push button 8. In this embodiment, snapping lip 80 need not be provided on skirt 81 of rotatable member 20. The upwardly extending portion of push button 8 many have the same general shape as actuator button 22.

It will be apparent to those skilled in the art that a variety of matching cross-sectional shapes could be used for hole 23 and upper portion 29. All that is necessary is that downward movement of push button 8 be prevented in most rotational positions of rotatable member 20 and that downward movement of push button 8 be allowed in at least one rotational position of rotatable member 20.

Index marks 95 may be provided on top cover 12 and an easily recognized index mark 96 may be provided on rotatable member 20 and to guide the rotation of rotatable member 20. Written instructions may also be provided on the top of actuator button 22. Rotational member 20 may be molded of a clear plastic material to allow the adult user to visually determine how to unlock the child-resistant feature.

Figure 3:
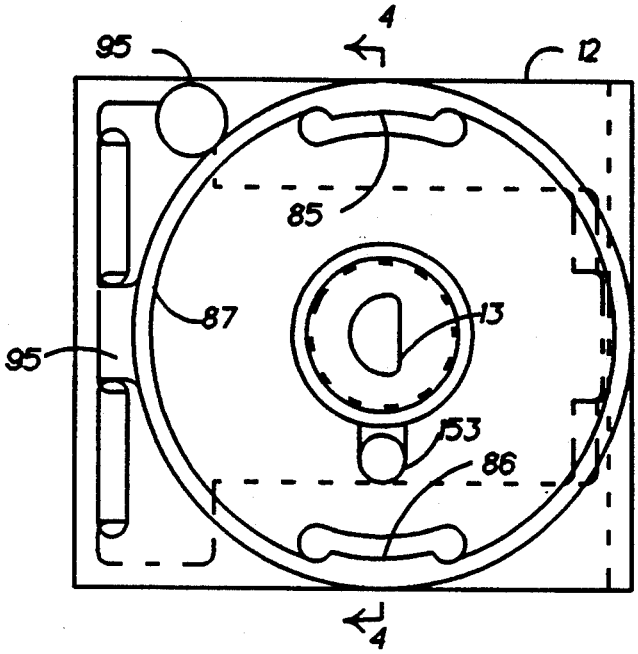
FIG. 3 is a plan view of the top cover of the invention shown in FIGS. 1 and 9.
Figure 4:
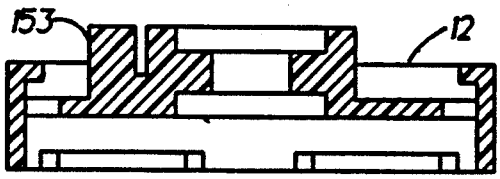
FIG. 4 is a cross-sectional view of the top cover shown in FIG. 3.
Figure 5:
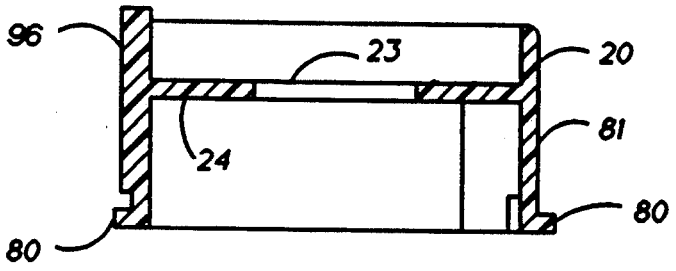
FIG. 5 is a cross-sectional view of the rotatable member of the invention shown in FIG. 1.
Figure 6:
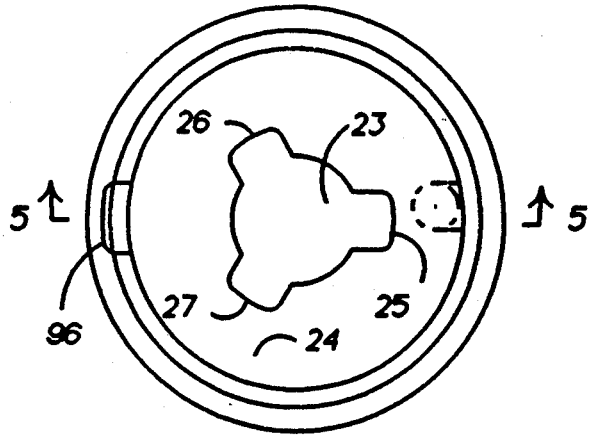
FIG. 6 is a plan view (upward) of the rotatable member shown in FIG. 5.
Figure 7:
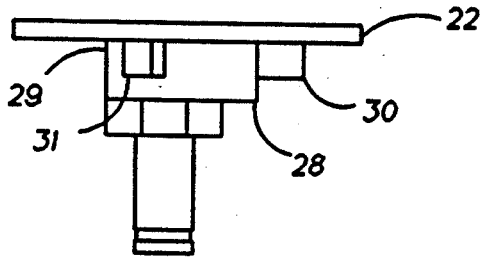
FIG. 7 is a side view of the actuator button of the invention shown in FIG. 1.
Figure 8:
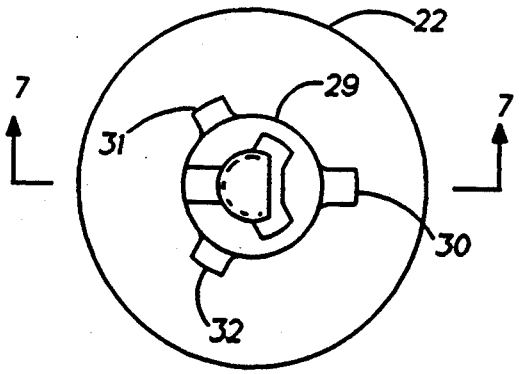
FIG. 8 a plan view (upward) of the actuator button shown in FIG. 7.
Figure 9:
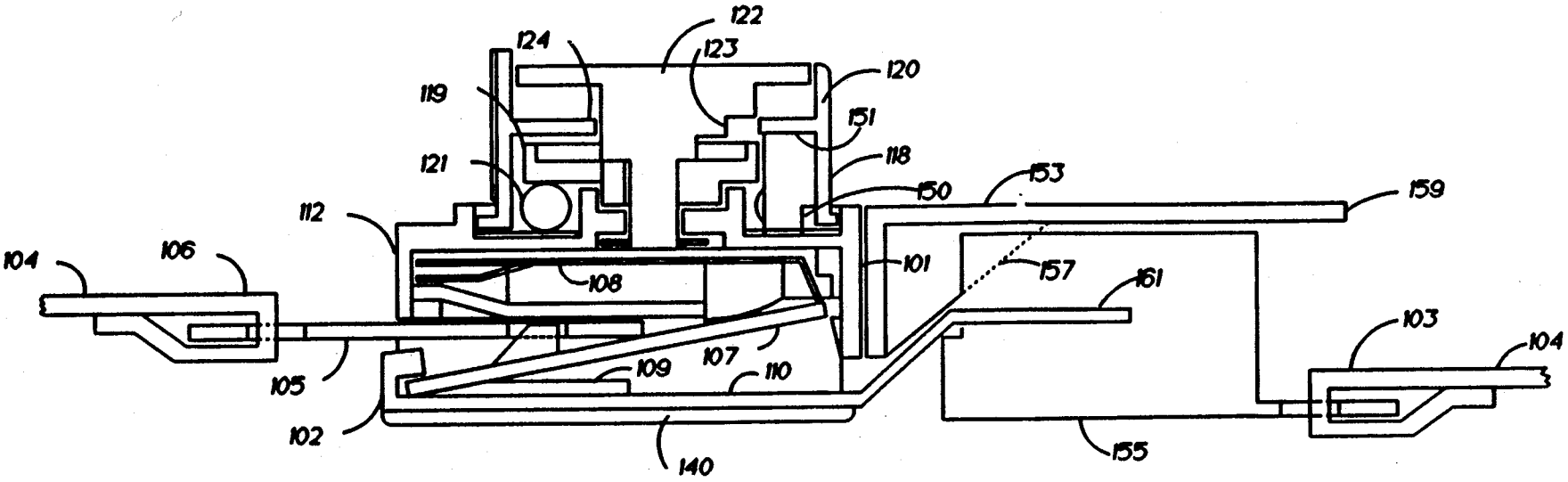
FIG. 9 is a cross-sectional view of the invention incorporating a two-tumbler combination lock mechanism.
Figure 10:
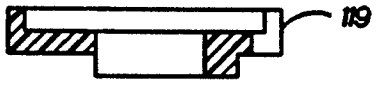
FIG. 10 is a cross-sectional view of the inner rotatable member of the invention shown in FIG. 9.
Figure 11:
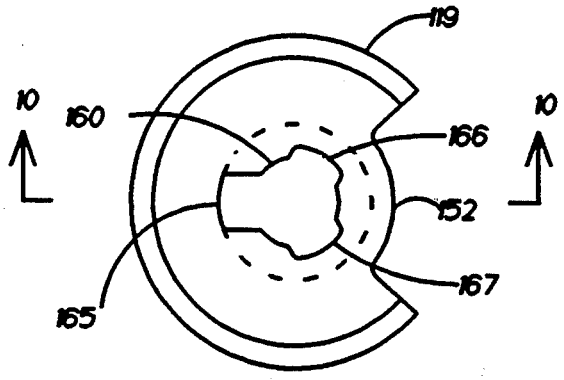
FIG. 11 is a plan view of the inner rotatable member shown in FIG. 10.
Figure 12:
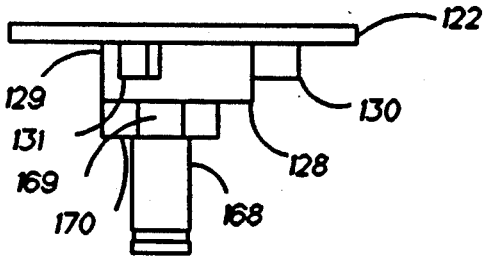
FIG. 12 is a side view of the actuator button of the invention shown FIG. 9.
Figure 13:
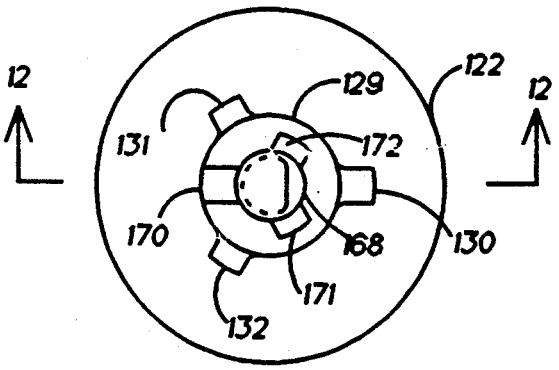
FIG. 13 is a plan view (upward) of the actuator button shown in FIG. 12.
Figure 14:
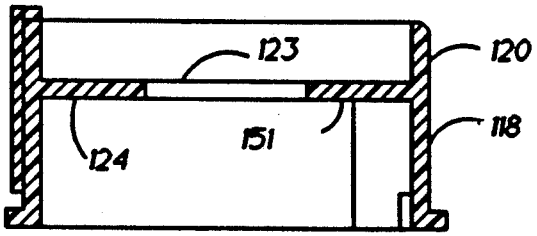
FIG. 14 is a cross-sectional view of the outer rotatable member of the invention shown in FIG. 9.
Figure 15:
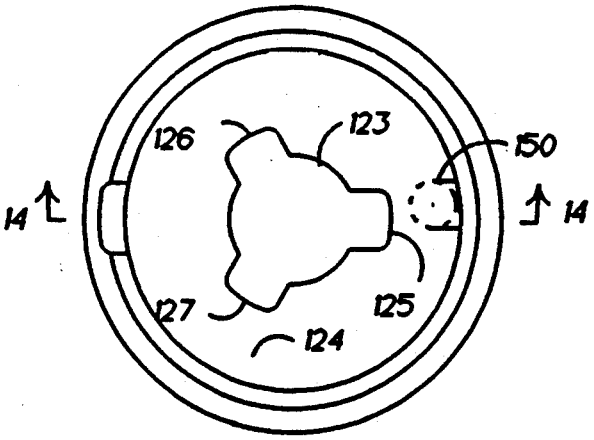
FIG. 15 is a plan view (upward) of the outer rotatable member shown in FIG. 14.

Another preferred embodiment of this invention incorporating a two-tumbler combination lock is shown on FIGS. 9 through 15. The components of this embodiment shown in FIGS. 9 through 15 that are similar to the components of the embodiment shown in FIGS. 1, 2, and 3 are numbered by adding 100 to the number used in FIGS. 1 through 8. In this embodiment, buckle 101 is modified by adding an integral child-resistant feature comprised of a plurality of rotatable members mounted on top cover 112. The rotatable members are nested with outer rotatable member 120 being generally cap-shaped and inner rotatable member 119 being generally disk-shaped. Outer rotatable member 120 comprises a disk portion 124 having a downwardly, extending skirt 118. Inner rotatable member 119 is adapted to fit within the skirt 118 of outer rotatable member 120. In this configuration, inner rotatable member 119 is not accessible to direct, manual manipulation by the buckle user while outer rotatable member 120 is accessible to such direct manual manipulation.

Both rotatable members 119 and 120 rotate in a horizontal plane about an axis perpendicular to the longitudinal axis of buckle 101. Skirt 118 of outer rotatable member 120 may extend horizontally to the edges of top cover 112. At a radial position less than the full radial extent of the disk portion 124 of outer rotatable member 120, a cylindrical stud 150 extends downward from the bottom surface 151 of disk portion 124. At a corresponding radial position on the inner rotatable member 119, an arcuate notch 152 is provided in the outer circumference of inner rotatable member 119. When buckle 101 is assembled, the cylindrical stud 150 extending downward from bottom surface 151 fits into arcuate notch 152 in inner rotatable member 119. By this means, manual manipulation (rotation) of outer rotatable member 120 can indirectly cause inner rotatable member 119 to rotate.

Spring 121 is mounted between inner rotatable member 119 and top cover 112. In this embodiment, spring 121 is an extension spring. One end of spring 121 is attached to cylindrical stud 153 (see FIG. 3) that extends upward from the top surface of top cover 112. The other end is attached to cylindrical stud 150. In other embodiments, one or two compression springs or a torsion spring may be used. Spring 121 is adapted to bias outer rotatable member 120 in a locked position of rotation that locks the child-resistant feature in a child-resistant condition. Because outer rotatable member 120 and inner rotatable member 119 are capable of interaction by means of cylindrical stud 150 and arcuate notch 152, spring 121 also biases inner rotatable member 119 in a locked position. This is the case because spring 121 causes outer rotatable member to turn which, in turn, causes cylindrical stud 150 to move in an arcuate motion within arcuate notch 152 in inner rotatable member 119 until the end of arcuate notch 152 is reached, after which time rotation of outer rotatable member 120 also causes rotation of inner rotatable member 119.

As shown in FIGS. 12 through 15, either a portion of push button 108 or a separate component, such as actuator button 122 extends upward through hole 123 in the center of the disk portion 124 of outer rotatable member 120 and through hole 160 in the center of inner rotatable member 119. Each hole 123, 160 is centered on the axis of rotation of its associated rotatable member. In this embodiment, the hole in each rotatable member is generally circular in horizontal cross section except for at least one notch 125, 165, and preferably three rectangular notches 125, 126, 127 and 165, 166, 167 in the circumference of otherwise circular holes 123 and 160. The portion of the actuator button 122 that extends upward through the hole in each rotatable member has two cross-sectional shapes. In the embodiment shown, the overall shape of the portion of actuator button 122 is stepped, with the portions in the vicinity of disk portion 124 being generally larger in diameter than that portions in the vicinity of inner rotatable member 119. Lower portions 128, 168 that are coincident with the rotatable members 119, 120 when buckle 101 is in the locked, child-resistant condition are circular in horizontal cross section. Upper portions 129, 169 are circular in horizontal cross section with essentially the same diameter as corresponding lower portions 128, 169 for the most part, but in at least are part of the circle circumference of upper portions 129, 169, rectangular projections 130, 170 are present. Preferably three rectangular projections 130, 131 and 132 and 170, 171 and 172 are present in each circumference. The rectangular projections 130, 131 and 132 and 170, 171 and 172 are slightly smaller than the corresponding rectangular notches 125, 126 and 127 and 165, 166 and 167 in the circumferences of holes 123 and 160, respectively. In a preferred embodiment, one of the rectangular projections on each actuator button upper portion, rectangular projections 130 and 170, and one of the rectangular notches in each hole circumference, rectangular notches 125 and 165, are longer in radial extent than their other two counterparts.

In at least one position of rotation of each rotatable member, the rotatable members 119, 120 are capable of accommodating both corresponding cross sections of actuator button 122 in that those portions can move vertically through corresponding holes 123 and 160. In other positions of rotating, holes 123 and 160 are capable of accommodating only the essentially circular lower portions 128, 168 and actuator button 122 which are presented to holes 123 and 160 when push button 108 is in the upward, locked, child-resistant condition.

The operation of this embodiment of the invention may also be understood by reference to FIGS. 9 through 15. To unlock the child-resistant feature, outer rotatable member 120 is rotated in a clockwise (viewed from above) direction sufficiently to rotate notch 165 in the circumference of hole 160 in inner rotatable member 119 into alignment with rectangular projection 170 on the actuator button 122. The inner rotatable member 119 is temporarily held in this position by frictional engagement of lower surface with an upper surface of relatively stationary top cover 112. Only a small amount of frictional engagement is required because no tangential force is exerted on inner rotatable member 119 other than that exerted by interaction with outer rotatable member 120.

Outer rotatable member 120 is then rotated in the counterclockwise direction to align notch 125 in the circumference of hole 123 in outer rotatable member 120 with rectangular projection 170 on relatively non-rotating actuator button 122. Actuator button 122 may then be depressed thus depressing push button 108 and allowing the release of tongue 105 from body 102 of buckle 101. When downward pressure on push button 108 is released, push button 108 and actuator button 122 are moved upward by latch 107 and spring 109, and the rotatable members 119, 120 are driven to rotate by spring 121 to locked positions.

Many variations in configuration have been discussed and other embodiments will be obvious to those skilled in the art. The invention is not to be construed as limited to the particular forms disclosed herein, since these are to be regarded as illustrative rather than restrictive. It is intention of this patent to cover all changes and modifications of the examples of the invention herein chosen for the purposes of the disclosure which do not constitute departures from the spirit and scope of the invention.

I claim:

1. A child-resistant buckle and buckle guard combination comprising a buckle having a child-resistant feature comprising an actuator button mounted on said buckle, said actuator button having a vertical axis, and a combination lock mechanism having at least one tumbler, said tumbler being rotatable about the vertical axis of said actuator button, means for connecting said buckle to a conventional safety belt buckle body, means for denying the child access to a conventional safety belt buckle release mechanism; and wherein the means for denying access to the release mechanism on said conventional safety belt buckle is a guard, said guard forcibly removable from said combination by an adult thereby allowing said adult access to said conventional safety belt buckle release mechanism.

2. The combination of claim 1 wherein the child-resistant feature comprises a combination lock mechanism having two rotatable tumblers.

3. The combination of claim 1 wherein the means for connecting said buckle to the body of a conventional safety belt buckle is a tongue or leaf.

4. The combination of claim 1 wherein the means for denying access to the release mechanism on said conventional safety belt buckle covers the conventional safety belt buckle push button and is selected from the group consisting of a guard, and a sleeve.

5. A child-resistant buckle and buckle guard combination comprising a child-resistant push-button buckle of the type comprising the elements of a body, a tongue insertable into said body in a direction parallel to the longitudinal axis of said push-button buckle, a latch member attached to said body capable of holding said tongue in said body, a push button mounted above said latch member for releasing said tongue from said body by movement of said latch member, a top cover for said body, means for blocking the movement of said push button and said latch member to positions wherein said tongue is released when said push-button buckle is in the locked, child-resistant condition, said means for blocking being mounted on said push button and means for returning said means for blocking to the locked, child-resistant condition, wherein said means for blocking is a rotatable member that is rotatable about an axis perpendicular to the longitudinal axis of said push-button buckle and said means for returning is a spring mounted between said rotatable member and said push button, means for connecting said buckle to the body of a conventional safety belt buckle, and means for denying access to the release mechanism on said conventional safety belt buckle.

6. The combination of claim 5 wherein the means for denying access to the release mechanism on said conventional safety belt buckle is a guard, said guard forcibly removable from said combination by an adult thereby allowing said adult access to said conventional safety belt buckle release mechanism.

7. A device as in claim 5, further comprising the improvement wherein the movement of said second means for preventing occurs only in a single plane when said safety belt buckle is in a child-resistant condition.

8. A device as in claim 5 wherein said means for blocking comprises a combination lock tumbler having an easily recognized index mark.

9. A child-resistant buckle and buckle guard combination comprising a push-button buckle of the type comprising the elements of a body, a tongue insertable into said body in a direction parallel to the longitudinal axis of said push-button buckle, a latch member attached to said body capable of holding said tongue in said body, a push button mounted above said latch member for releasing said tongue from said body by movement of said latch member, a top cover for said body, means for blocking the movement of said push button and said latch member to positions wherein said tongue is released when said push-button buckle is in the locked, child-resistant condition, said means for blocking being mounted on said top cover and means for returning said means for blocking to the locked, child-resistant condition wherein said means for blocking is a rotatable member that is rotatable about an axis perpendicular to the longitudinal axis of said push-button buckle and said means for returning is a spring mounted between said rotatable member and said top cover, means for connecting said buckle to the body of a conventional safety belt buckle, and means for denying access to the release mechanism on said conventional safety belt buckle.

10. The combination of claim 9 wherein the means for denying access to the release mechanism on said conventional safety belt buckle is a guard, said guard forcibly removable from said combination by an adult thereby allowing said adult access to said conventional safety belt buckle release mechanism.

11. A child-resistant buckle and buckle guard combination comprising a buckle improved to provide child resistance having a body, a latch positioned in said body and held captive therein, said latch movable between a latched position and an unlatched position, spring means contacting said latch biased to move said latch to said latched position, operator means operable to move said latch to said unlatched position, and a cover mounted to said main body and enclosing said latch, said spring means and said plate, said cover including means securing said cover to said body, at least one first means for preventing the motion of said operator means when said first means for preventing is in at least one position, said first means for preventing being rotatably attached to said cover and accessible to direct manual manipulation, and at least one means for returning said means for preventing to said at least one position in the absence of manual manipulation of said first means for preventing, at least one second means for preventing the motion of said operator means when said second means for preventing being rotatably attached to said cover and inaccessible to direct manual manipulation, and at least one position in the absence of manual manipulation of said first means for preventing, means for connecting said buckle to the body of a conventional safety belt buckle, and means for denying access to the release mechanism on said conventional safety belt buckle.

12. The combination of claim 11 wherein the means for denying access to the release mechanism on said conventional safety belt buckle is a guard, said guard forcibly removable from said combination by an adult thereby allowing said adult access to said conventional safety belt buckle release mechanism.

* * * * *